US005654106A

United States Patent [19]

Purnell et al.

[11] Patent Number: 5,654,106

[45] Date of Patent: Aug. 5, 1997

[54] SINTERED ARTICLES

[75] Inventors: Charles Grant Purnell, Coventry; Helen Ann Brownlie, Altrincham, both of United Kingdom

[73] Assignee: Brico Engineering Limited, Coventry, United Kingdom

[21] Appl. No.: 403,905

[22] PCT Filed: Sep. 21, 1993

[86] PCT No.: PCT/GB93/01982

§ 371 Date: Mar. 20, 1995

§ 102(e) Date: Mar. 20, 1995

[87] PCT Pub. No.: WO94/06589

PCT Pub. Date: Mar. 31, 1994

[30] Foreign Application Priority Data

Sep. 24, 1992 [GB] United Kingdom ..... 9220181

[51] Int. Cl.[6] ..... B22F 3/26

[52] U.S. Cl. ..... 428/547; 428/550; 428/566; 428/567; 419/27; 419/47

[58] Field of Search ..... 419/27, 47; 428/550, 428/547, 566, 567

[56] References Cited

U.S. PATENT DOCUMENTS

| | | | |
|---|---|---|---|
| 3,652,261 | 3/1972 | Taubenblat | 75/0.5 R |
| 3,717,442 | 2/1973 | Knopp | 29/182.2 |
| 4,412,643 | 11/1983 | Sato et al. | 228/221 |
| 4,425,299 | 1/1984 | Koiso | 419/6 |
| 4,485,147 | 11/1984 | Nishino et al. | 428/550 |
| 4,556,532 | 12/1985 | Umeha et al. | 419/5 |
| 4,787,129 | 11/1988 | Williamson | 29/149.5 C |
| 4,857,695 | 8/1989 | Monden et al. | 219/85.22 |
| 4,976,778 | 12/1990 | Berry et al. | 75/254 |
| 5,203,488 | 4/1993 | Wang et al. | 228/122 |

FOREIGN PATENT DOCUMENTS

| | | |
|---|---|---|
| 497714A1 | 1/1992 | European Pat. Off. . |
| 2236328 | 4/1991 | United Kingdom . |

OTHER PUBLICATIONS

Patent Abstracts of Japan, vol. 014572 (M-1061), dated Dec. 19, 1990, entitled "Method for Infiltration-Joining Sintered Member", JP890066368.

Patent Abstracts of Japan, vol. 012404 (M757), dated Oct. 26, 1988, entitled "Production of Composite Sintered Iron Parts", JP860292857.

*Primary Examiner*—Charles T. Jordan
*Assistant Examiner*—Chrisman D. Carroll
*Attorney, Agent, or Firm*—Synnestvedt & Lechner

[57] ABSTRACT

A method of making an article by joining together at least two porous components is described, the method comprising the steps of making at least two generally tubular PM components to be joined in the axial direction, each component having an axial length less than that of the tubular article; the at least two components both having interconnected porosity and each having at least one mutual mating face; assembling the at least two components together so that the at least one mutual mating faces are in proximity to each other; placing an infiltrant material in the bore of the assembled components; heating the assembled components to melt the infiltrant material and cause it to infiltrate the interconnected porosity at least in the region of the mutual mating faces so as to cause the components to become bonded together by the infiltrant material. Examples of the manufacture of valve guides are given.

11 Claims, 3 Drawing Sheets

SINTERED ARTICLES

BACKGROUND OF THE INVENTION

The present invention relates to a method for the manufacture of elongate tubular articles by powder metallurgy (PM) techniques and to a product produced thereby.

SUMMARY OF THE INVENTION

Articles having a generally elongate tubular form may be used in many diverse applications such as, for example, valve guides for engines and bearing bushes for sliding contact. The present invention will be illustrated by the particular problems associated with the manufacture of valve guides for internal combustion engines, but it is stressed that the method described hereinafter is equally applicable to the manufacture of many other articles having a generally elongate tubular form.

It is known to manufacture valve guides by PM techniques for the types of engine generally found in passenger car vehicles for example. Such guides are generally of relatively plain tubular form and have an axial length of less than 70 mm. Such valve guides are produced in very large numbers. PM valve guides are frequently manufactured from ferrous materials and may or may not be infiltrated with, for example, a copper-based alloy. Infiltration with such alloys can greatly improve both the machinability of the guide during manufacture and the wear-resistance in service.

Conventionally, larger valve guides for the types of engine used in generating sets, military vehicles, marine propulsion applications, larger commercial vehicles such as trucks and highway construction vehicles for example, have used valve guides machined from solid, cast materials. Valve guides used in these larger types of engine are often of relatively intricate design having machined features such as location flanges or grooves for example. With the advent of ever more stringent environmental regulations applying to the emissions from all engines and also due to the constant pressure to improve the performance of all components that go into an engine, it is being found that the conventional cast materials such as cast-iron and phosphor-bronze no longer have the wear resistance demanded by the higher loads and temperatures of modern higher performance engines. In addition to this, materials such as phosphor-bronze are very expensive.

PM manufacturing techniques allow the materials engineer to fine-tune material compositions and the metallurgical microstructure in a way that is denied to conventional ingot metallurgy, this is particularly so in the case of composite microstructures which are highly suited to sliding and bearing applications. Alloy compositions and microstructures may be produced which are impossible to produce by ingot metallurgy methods. However, the pressing of valve guides is limited to a maximum axial length of about 70 mm. This limitation is due to the height of the powder column which may be pressed and which is constrained by press dimensions, kinetics and most importantly by frictional energy losses at the pressing tool/pressed component interfaces and within the body of the compressed powder mass itself. The result of these losses is a variation in density between the axial ends of the pressed tube and the mid-point, assuming that double-ended pressing is employed. At about 70 mm axial length, the mid-point of the tube has a significantly lower density than the ends of the tube resulting in weakness. The variation in density between the ends and the mid-point increases as the length of the pressed tube increases, leading to the stated practical maximum of 70 mm axial length. This limitation on length has not permitted powder metallurgy valve guides to enter the field of larger engines significantly.

In the case of a non-infiltrated valve guide, the lower density at the mid-point produces an area of weakness which makes the pressed blank (called a "green" blank) susceptible to damage by cracking, chipping-or fracture during handling prior to sintering. In the case of an infiltrated guide, the above disadvantages still occur, but there is the additional disadvantage that the lower density, weaker centre region which is more porous, has a significantly greater concentration of expensive infiltrant, perhaps at the expense of the stronger, less porous end regions. This is disadvantageous not only because expensive infiltrant is effectively wasted but also because the operative areas of a valve guide are at the axial end regions where wear is highest due to the side loads and rocking motion imparted by the valve actuating mechanism.

It is an object of the present invention to provide a method for the manufacture of a generally tubular article from at least two porous generally cylindrical components. It is a further object to provide a generally tubular article with an improved uniformity of matrix density and an improved uniformity of overall composition along its length which can be of length greater than that currently attainable by PM techniques. It is a yet further object to provide a PM valve guide of longer axial length than is currently attainable.

According to a first aspect of the present invention there is provided a method of making a generally tubular article the method comprising the steps of making at least two generally tubular PM components to be joined in the axial direction, each component having an axial length less than that of the tubular article; said at least two components having interconnected porosity and each having at least one mutual mating face; said at least one mutual mating faces providing a butt joint in the article; assembling said at least two components together so that said at least one mutual mating faces are in proximity to each other; heating the assembled components to melt the infiltrant material and cause it to infiltrate said interconnected porosity through the interfaces of the mutual mating faces so as to cause said components to become bonded together by the infiltrant material characterised in that the density variation between the ends and middle of said two powder metallurgy components is 7% or less and by placing an infiltrant material in the bore of the assembled components.

The quantity of infiltrant material may be matched to the available porosity in the at least two components.

Preferably, the infiltrant material occupies substantially all of the available interconnected porosity as a result of the infiltrating step. However, in the case where the tubular article being produced is a valve guide, it is desirable that the infiltrant material, which may be copper or a copper alloy, is also present in at least the interconnected porosity adjacent the ends of the resulting tubular article.

The infiltrant material may be any suitable non-ferrous metal or alloy.

In the case of valve guides for internal combustion engines, the PM constituent components may be pressed from a ferrous-based powder material. Each constituent PM component which is joined axially to another may generally not be more than 70 mm in length in the pressing direction. The density variation between the axial ends of each such component in the green state and the mid-position (assuming double-ended pressing) does not exceed 7% of the average as pressed (green) density. Therefore, if each constituent component has an average green density of about 6.9 $Mg/m^3$, the density variation from end to middle would not exceed about 0.5 $Mg/m^3$. More preferably, the axial length of each constituent component may not exceed 60 mm, and the end to middle density variation, more preferably may not exceed 6%.

The at least two tubular components being joined may also have co-operating features applied to their co-operating axial ends to provide at least an initial mechanical interlocking capability prior to an infiltration step. The form of the co-operating features may be a cylindrical or truncated conical plug and socket arrangement for example, producing for example, a congruent bore in the interfitted tubular components. Other co-operating end features such as castellations or sinusoidal teeth for example may be employed. In the case of a plug and socket, different features are required on each end of the tubular component. However, a common component may be produced, if desired, having the necessary plug feature at one end and the socket feature at the other end, the unwanted features being removed during subsequent machining. Alternatively, separate components may be produced, one having a socket at one end and the other having a plug feature at one end. The cooperating features may be introduced either during the pressing cycle as features applied by virtue of the die form, or may be applied by a machining operation subsequent to a sintering operation, for example.

The infiltration step is accomplished either concurrently with a sintering operation or subsequently thereto. In either case the limitation on length of the final generally tubular component is no longer dependent on the pressing operation. Where the infiltration step is carried out subsequently to sintering, the components may be given some intervening processing such as, for example, machining to remove die pressing "flash" or a sizing operation prior to assembling together. The infiltration step provides a bonding agent which passes through the porosity of the joined components giving a continuous phase therethrough. Not only does the infiltrant form a continuous phase per se, but it also can promote the diffusion of the constituent elements of the materials which form the matrices of the joined components by liquid phase sintering, thus giving enhanced bonding therebetween. One further advantage of infiltration is that the excellent tribological properties of the tubular component are developed throughout; at the O.D., I.D., ends and any surface revealed by subsequent machining.

An additional advantage given by the method of the present invention is the ability to employ different matrices in the at least two components to give a functionally graded article wherein the different matrices are tailored to the particular environment in which they operate. A valve guide for example may have to survive very high temperatures with little or no lubrication at one end where it is subjected to hot exhaust gases, whilst the other end may have better lubrication, much lower temperatures but may have greater side loads due to the valve actuating mechanism. Therefore, a matrix having a lower temperature capability but superior wear resistance and friction properties may be employed at the lubricated end whilst a more oxidation and corrosion resistant material may be used for the component which lies in the region exposed to the hot exhaust gases. Application of the method of the present invention requires both the matrix interacted and infiltrant jointly to accommodate such environmental and property requirements.

In addition to the ability of joining at least two tubular components in the axial direction to produce longer articles, the method also allows component pieces to be joined in the radial direction giving the ability to bond, for example, a ring on the outer diameter in order to machine a feature such as a flange. The method also permits the at least two tubular components to produce longer articles incorporating internal recesses, a feature not readily achievable by conventional powder metal pressing techniques in single articles.

As has been stated above, conventional pressing techniques limit the maximum effective axial length of valve guide components to about 70 mm in the range of bore and O.D. sizes normally made for such parts. Even at this length the centre region is substantially less dense and therefore weaker. With the method of the present invention it is possible to make a guide which is, for example, 100 mm in length from two tubular components which are approximately 50 mm in length; the resulting guide having a more uniform structure and properties than a unitary guide of significantly shorter length.

Unlike valve guides for the smaller types of engine used passenger vehicles for example, where the guides need to be finished almost to net-shape by the PM process to minimise subsequent costs due to machining, the longer guides used in bigger engines are more tolerant with regard to cost as substantial machining is often an intrinsic part of their production process.

According to a second aspect of the present invention there is provided an article when made by the method of the first aspect of the present invention.

BRIEF DESCRIPTION OF THE DRAWINGS

In order that the present invention may be more fully understood, examples will now be described by way of illustration only with reference to the accompanying drawings, of which.

DETAILED DESCRIPTION OF THE INVENTION

Figure 1:
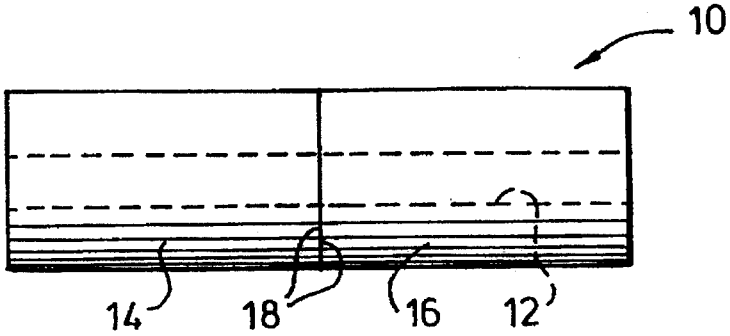
FIGS. 1 to 4 show side and corresponding end views of tubular components having alternative end features to facilitate joining together.
Figure 1A:
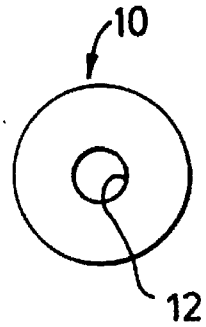

Referring now to the drawings and where FIG. 1 shows a tubular article 10 having a bore 12 therethrough. The article 10 comprises two separate pressed tubular components 14 and 16 which have mating faces 18. The two components have been joined by infiltration of the residual porosity in the pressed matrices.

Figure 2:
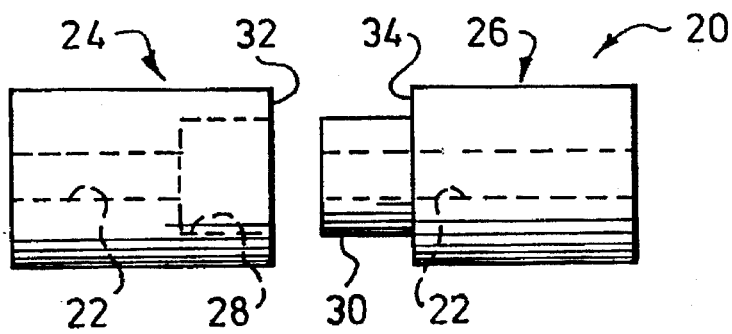
Figure 2A:
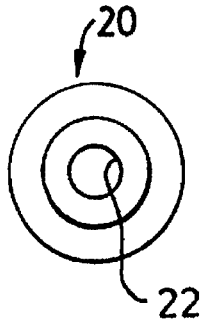

FIG. 2 shows a tubular article 20 having a bore 22, the article 20 comprising two components 24, 26. One component 24 has a socket feature 28 and component 26 has a cooperating plug feature 30. Components 24, 26 have co-operating faces 32, 34 respectively. Although shown as two different pressings, a single pressing having the plug feature 30 at one end and the socket feature 28 at the other may be made to avoid the necessity of two separate die sets, the unwanted features being removed by machining after sintering and infiltration.

Samples according to those shown in FIGS. 1 and 2 were prepared by pressing components from a ferrous-based powder and joined by infiltration of the residual porosity with a copper-based alloy according to the method described in our Patent No. GB2236328B. The samples had the co-operating faces 18 (FIG. 1) and 32, 34 (FIG. 2) either butted together in contact or spaced apart with a gap of 0.010" prior to infiltration. The constituent tubular components were first sintered and then assembled as described above prior to infiltrating with a copper-based alloy. The infiltrated samples had an outer diameter of 12.65 mm and a bore of 7.5 mm and were tested by a three-point bend test wherein support fulcra were spaced 94 mm apart and the load applied by a third point at mid-span adjacent the join, the results being given in the Table below.

| Sample Number | Condition | Maximum Load (kN) |
|---|---|---|
| 1 | Butt contact | 1.22 |
| 2 | Butt contact | 4.94 |
| 3 | 0.010" gap | 1.89 |
| 4 | 0.010" gap | 0.93 |
| 5 | Butt contact | 5.26 |
| 6 | Butt Contact | 4.25 |
| 7 | 0.010" gap | 2.04 |

Sample numbers 1 to 4 had joint geometries as shown in FIG. 1, whilst sample numbers 5 to 7 had joint geometries as shown in FIG. 2. Those samples where the faces were spaced apart were found to be bonded in spite of the gap, the molten infiltrant surface tension providing a gap filling capability. Samples 1 to 4 although strongly bonded in some cases, failed by breaking into two pieces once the maximum load had been reached. Samples 5 to 7 continued to deform without breaking after the maximum load had been reached. The fracture surfaces of samples 1 to 4 were mainly through the infiltrant with some propagation through the matrix. The fracture surfaces of samples 5 and 6 alone propagated entirely through the matrix. Metallographic sections through the joint showed a clear layer of infiltrant transverse to the long axis, but in regions where the joint was parallel to the long axis the interface could hardly be distinguished. The strengths achieved in the tests are entirely adequate in applications such as, for example, valve guides in internal combustion engines where the maximum subjected load would be due to the fitting forces during assembly into the engine.

Figure 3:
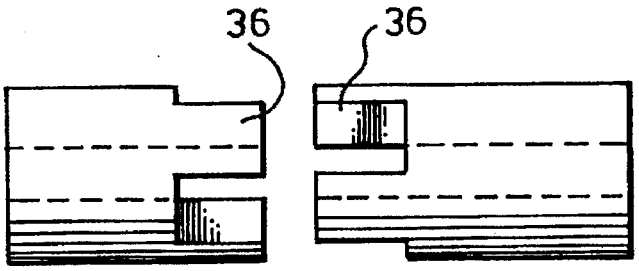
Figure 3A:
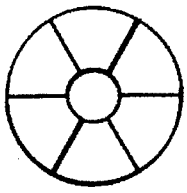
Figure 4:
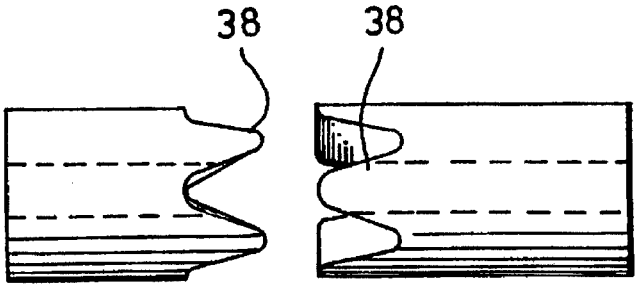
Figure 4A:
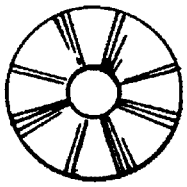

FIGS. 3 and 4 give alternative geometries of the co-operating ends, and have the additional advantage of requiring only one die set. FIG. 3 has castellations 36 provided at one end, and FIG. 4 has a sinusoidal waveform 38.

Figure 5:
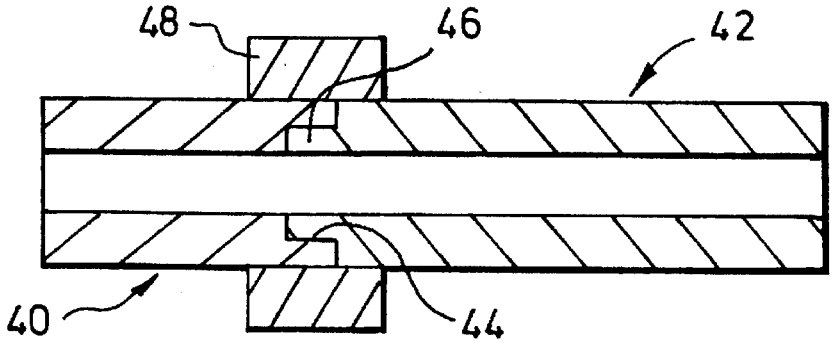
FIG. 5 shows an axial cross section through an arrangement of components to allow an article having a flange feature to be formed.

FIG. 5 shows an arrangement whereby a basic tubular article is formed from two tubular components 40, 42; component 40 having a socket feature 44 at one end and component 42 having a co-operating plug feature 46. A ring component 48 is positioned over the outer diameter adjacent the joint and the three components are joined together during sintering or infiltration as described above. The ring 48 may be used for the subsequent machining of a flange feature for example. One advantage of this is that under normal circumstances the article would be machined from a regular tubular blank. Thus, the method of the invention provides for considerable material savings in addition to the performance advantages to be gained from being able to provide the optimum material structure in the correct place.

Figure 6:
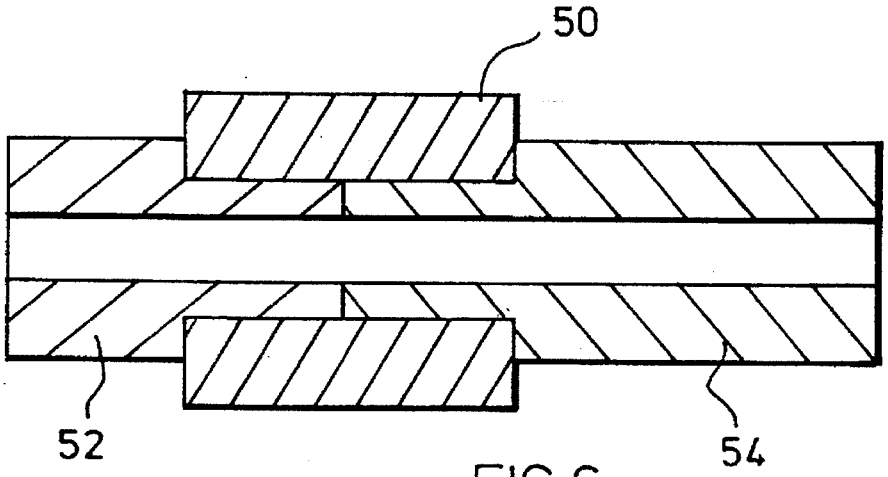
FIG. 6 shows an alternative arrangement for producing a flange feature to that shown in FIG. 5.

FIG. 6 shows an alternative arrangement whereby a third tubular component 50 may provide a larger outer diameter at a desired location. In this embodiment, the tubular component 50 effectively provides a socket at each end into which tubular components 52, 54 may be fitted. Clearly, the components 52, 54 may be plain tubes if desired, depending upon the required geometry of the finished article.

Figure 7:
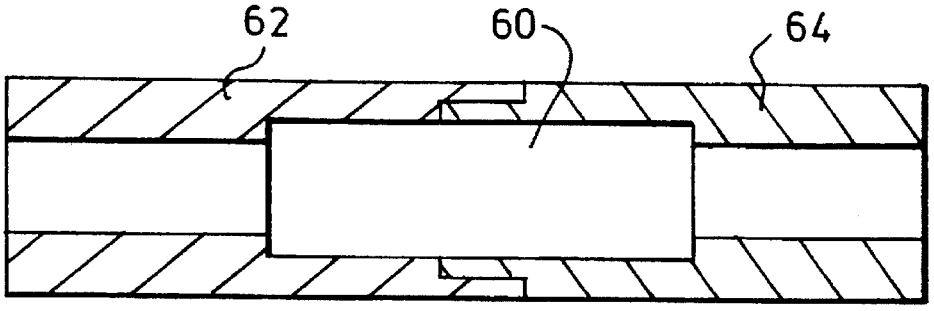
FIG. 7 shows an axial cross section through a bushing having a relieved bore portion.

FIG. 7 shows an embodiment whereby a lubricant reservoir 60, for example, is provided in the centre after joining of two tubular components 62, 64.

In the case of infiltration the quantity of infiltrant provided can be increased or reduced adjacent to the special feature of FIGS. 5, 6 or 7 to match the available porosity by use of several infiltrant blanks of varying volume or thickness.

Figure 8:
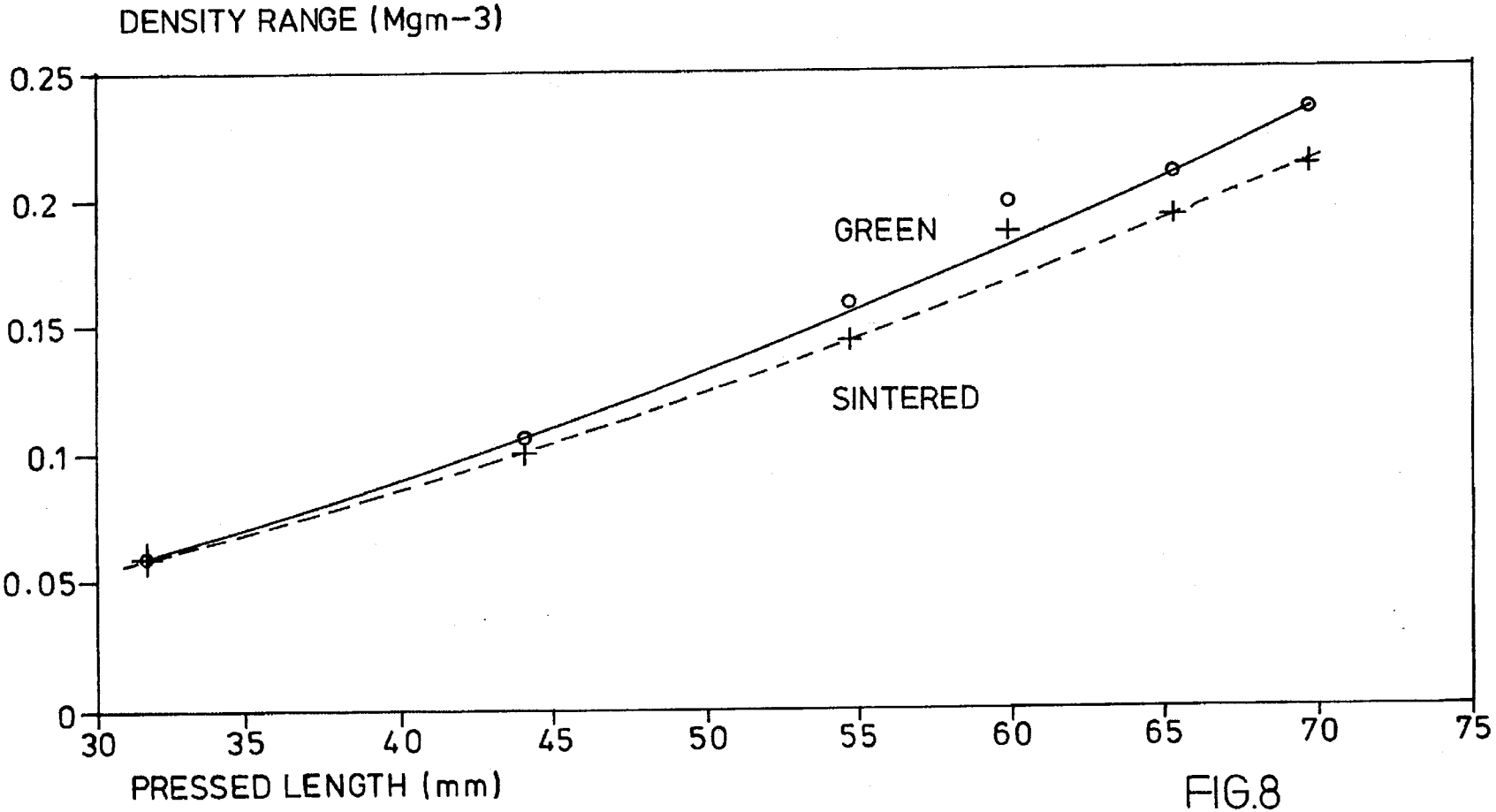
FIG. 8 which shows a graph of as-pressed density variation against pressed length for a ferrous material.

FIG. 8 shows a graph of density variation of valve guides from the axial ends to the centre against pressed length for a ferrous PM valve guide material containing from 1.5 to 2.5 wt % of carbon and 3 to 6 wt % of copper. Curves are shown for both the as pressed and sintered conditions. The results given in FIG. 8 are merely illustrative of one set of pressing dimensions (I.D. and O.D.) for one material. The actual density variation with pressed length will differ for other pressing dimensions (I.D. and O.D.) and for different material compositions being pressed.

It will be appreciated by those skilled in the art that the examples given above form only a small proportion of those articles which could be made by the method of the present invention and that the invention is limited only by the appended claims.

We claim:

1. A method of making a generally long tubular article having a bore therethrough, the method comprising the steps of pressing at least two generally tubular powder metallurgy components which are joined together in an axial relationship, each said component having an axial length less than that of the tubular article; said at least two components having interconnected porosity and each having at least one mutual mating face; said at least one mutual mating faces providing a butt joint in said article; assembling said at least two components together so that said at least one mutual mating faces are in proximity to each other and constitute an interface, placing an infiltrant material in the bore of the assembled components; heating the assembled components to melt the infiltrant material and cause said infiltrant material to infiltrate said interconnected porosity including through the interface between said at least one mutual mating faces so as to cause said components to become bonded together by the infiltrant material, wherein each of said two generally tubular powder metallurgy components have a density variation between the ends and middle thereof of 7% or less in the pressed and uninfiltrated condition, wherein the length of each of said two components is less than 70 mm and the quantity of said infiltrant material is matched to the available porosity of said two components and said infiltrant material substantially fills said interconnected porosity.

2. A method according to claim 1 wherein each of the at least one mutual faces includes a cylindrical or otherwise curved surface.

3. A method according to claim 1 wherein said at least two porous components are sintered prior to said infiltration step.

4. A method according to claim 1 wherein said at least two porous components are sintered and infiltrated in one operation.

5. A method according to claim 1 wherein said components are subjected to an operation to adjust size or shape to provide the at least one mutual mating face prior to infiltration.

6. A method according to claim 1 wherein said at least two powder metallurgy components comprise ferrous-based materials.

7. A method according to claim 1 wherein the at least two porous components comprise at least two different material compositions.

8. A method according to claim 1 wherein the infiltrant material is copper, a copper alloy or other non-ferrous metal or alloy.

9. A method according to claim 1 wherein the quantity of the infiltrant material is matched to the available porosity in the at least two components.

10. A method according to claim 1 wherein the generally tubular article is a valve guide for an internal combustion engine.

11. An article when made by the method claim 1.

* * * * *